US011849901B2

(12) United States Patent
Oh et al.

(10) Patent No.: US 11,849,901 B2
(45) Date of Patent: Dec. 26, 2023

(54) DISHWASHING APPLIANCE AND METHODS FOR IMPROVED CALIBRATION USING IMAGE RECOGNITION

(71) Applicant: Haier US Appliance Solutions, Inc., Wilmington, DE (US)

(72) Inventors: Jee Eun Oh, Anyang (KR); Je Kwon Yoon, Seongnam (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 1 day.

(21) Appl. No.: 17/463,899

(22) Filed: Sep. 1, 2021

(65) Prior Publication Data

US 2023/0069659 A1 Mar. 2, 2023

(51) Int. Cl.
*A47L 15/42* (2006.01)
*A47L 15/02* (2006.01)

(52) U.S. Cl.
CPC ..... *A47L 15/4297* (2013.01); *A47L 15/4223* (2013.01); *A47L 15/4295* (2013.01); *A47L 15/02* (2013.01); *A47L 15/428* (2013.01); *A47L 2401/10* (2013.01); *A47L 2501/02* (2013.01); *A47L 2501/36* (2013.01)

(58) Field of Classification Search
None
See application file for complete search history.

(56) References Cited

U.S. PATENT DOCUMENTS

| | | | | |
|---|---|---|---|---|
| 7,558,690 | B2 | 7/2009 | Curtius | |
| 2019/0380559 | A1* | 12/2019 | Lee | G06T 7/74 |
| 2021/0093153 | A1* | 4/2021 | Boyer | A47L 15/4225 |

FOREIGN PATENT DOCUMENTS

| | | | |
|---|---|---|---|
| CN | 110955166 | A | 4/2020 |
| CN | 111560732 | A | 8/2020 |
| EP | 1238623 | B1 | 7/2005 |
| KR | 102119076 | B1 | 6/2020 |

* cited by examiner

*Primary Examiner* — Rita P Adhlakha
(74) *Attorney, Agent, or Firm* — Dority & Manning, P.A.

(57) ABSTRACT

A dishwashing appliance may include a cabinet, a tub, a spray assembly, a drain pump, a turbidity sensor, and a controller. The tub may be positioned within the cabinet and defining a wash chamber for receipt of articles for washing. The spray assembly may be positioned within the wash chamber. The drain pump may be in fluid communication with the wash chamber. The turbidity sensor may be mounted within the cabinet. The controller may be in operative communication with the turbidity sensor and the drain pump. The controller may be configured to initiate a wash operation. The wash operation may include initiating a rinse cycle, obtaining an image of the wash chamber, determining calibration viability for the turbidity sensor based on the obtained image, and adjusting a calibration state of the turbidity sensor based on the determined calibration viability.

20 Claims, 6 Drawing Sheets

DISHWASHING APPLIANCE AND METHODS FOR IMPROVED CALIBRATION USING IMAGE RECOGNITION

FIELD OF THE INVENTION

The present subject matter relates generally to washing appliances, and more particularly to dishwashing appliances, including systems and methods for using image recognition for sensor calibration.

BACKGROUND OF THE INVENTION

Dishwashing appliances generally include a tub defining a wash chamber or compartment wherein one or more rack assemblies, into which various articles may be loaded for cleaning, are positioned. Each rack may include features such as, for example, tines that hold and orient the articles to receive sprays of wash and rinse fluids during the cleaning process. The articles to be cleaned may include a variety of dishes, cooking utensils, silverware, and other items.

In some conventional dishwashing appliances, one or more sensors are used to evaluate the quality or cleanliness of water being used within the appliance. For instance, a turbidity sensor may be provided to measure the turbidity level (e.g., cloudiness or amount of suspended particles) for a volume of water provided to the dishwashing appliance. Such measurements may be useful in determining if adjustments or additional cycles within a washing operation are need, such as discrete drain or rinse cycles.

In spite of the utility of sensors for sensors to evaluate the quality or cleanliness of water, various issues can arise with such sensors. As an example, over time, foreign objects, such as biofilm, food contaminants, or dust particles, may accumulate on one or more surfaces of a sensor. This may be especially true if water within the dishwashing appliance is particularly dirty (e.g., miscolored, cloudy, containing relatively large particulate, etc.) or if multiple cycles of dirty/unclean water have been circulated through the dishwashing appliance. In turn, the sensor may be unable to accurately evaluate or measure the water. As an additional or alternative example, inappropriate calibration of a given sensor may render that sensor inaccurate. Although calibration of the sensor may be necessary or desirable (e.g., according to a predetermined or programmed schedule), if water within the dishwashing appliance is dirty during calibration, future measurements or readings from the sensor may be inaccurate.

As a result, an appliance or method addressing one or more of the above issues would be useful. In particular, it may be advantageous for an appliance or method to include features or steps to prevent inaccurate readings or calibration from a sensor (e.g., turbidity sensor) of the appliance.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a dishwashing appliance is provided. The method may include initiating a rinse cycle and obtaining an image of a wash chamber. The method may further include determining calibration viability for a turbidity sensor based on the obtained image and adjusting a calibration state of the turbidity sensor based on the determined calibration viability.

In another exemplary aspect of the present disclosure, a dishwashing appliance is provided. The dishwashing appliance may include a cabinet, a tub, a spray assembly, a drain pump, a turbidity sensor, and a controller. The tub may be positioned within the cabinet and defining a wash chamber for receipt of articles for washing. The spray assembly may be positioned within the wash chamber. The drain pump may be in fluid communication with the wash chamber. The turbidity sensor may be mounted within the cabinet. The controller may be in operative communication with the turbidity sensor and the drain pump. The controller may be configured to initiate a wash operation. The wash operation may include initiating a rinse cycle, obtaining an image of the wash chamber, determining calibration viability for the turbidity sensor based on the obtained image, and adjusting a calibration state of the turbidity sensor based on the determined calibration viability.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
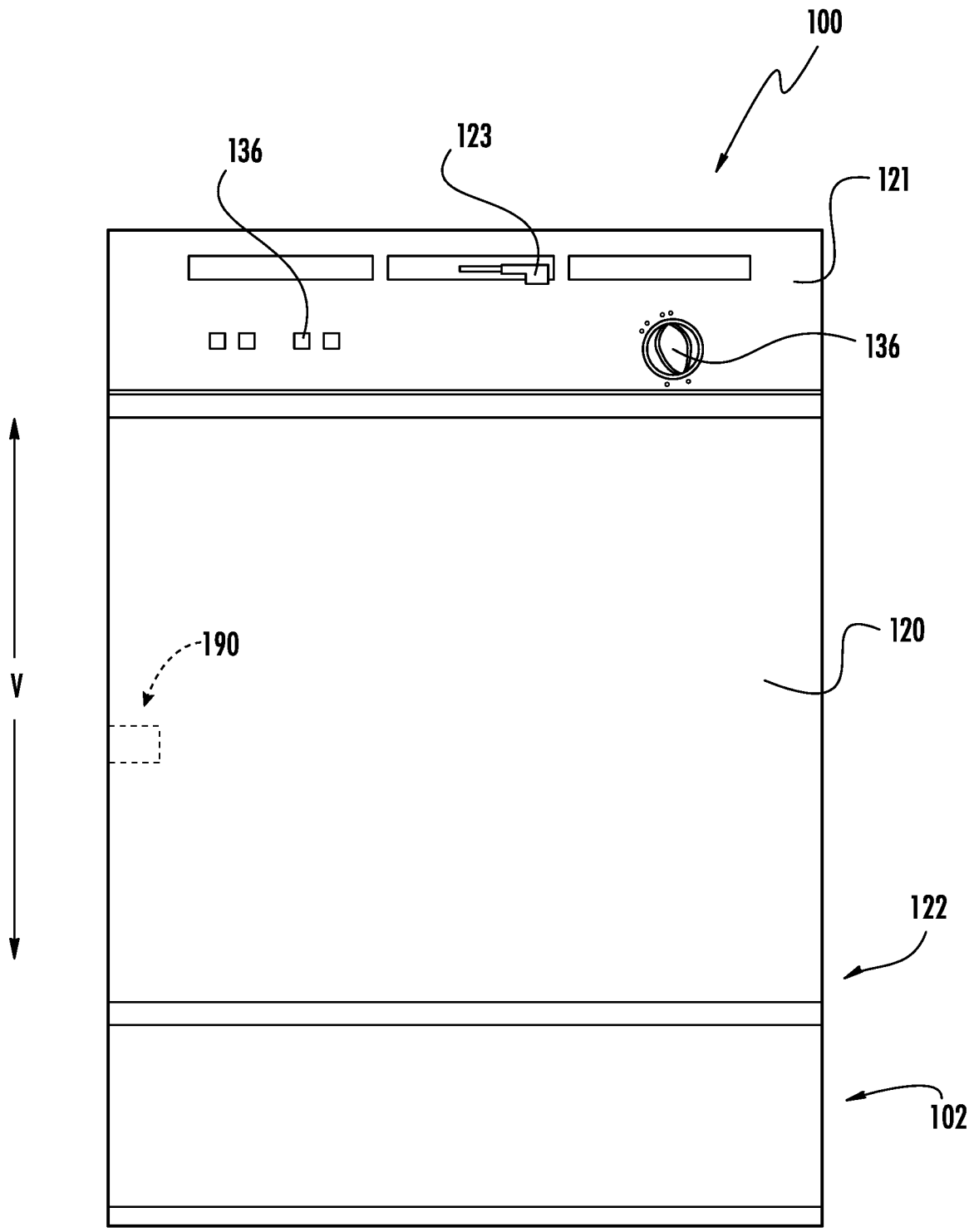
FIG. 1 provides a front perspective view of a dishwashing appliance according to exemplary embodiments of the present disclosure.

Reference now will be made in detail to embodiments of the invention, one or more examples of which are illustrated in the drawings. Each example is provided by way of explanation of the invention, not limitation of the invention.

In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V). The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Terms such as "inner" and "outer" refer to relative directions with respect to the interior and exterior of the dishwashing appliance, and in particular the wash chamber defined therein. For example, "inner" or "inward" refers to the direction towards the interior of the dishwashing appliance. Terms such as "left," "right," "front," "back," "top," or "bottom" are used with reference to the perspective of a user accessing the dishwashing appliance. For example, a user stands in front of the dishwashing to open the door and reaches into the wash chamber to access items therein.

Figure 2:
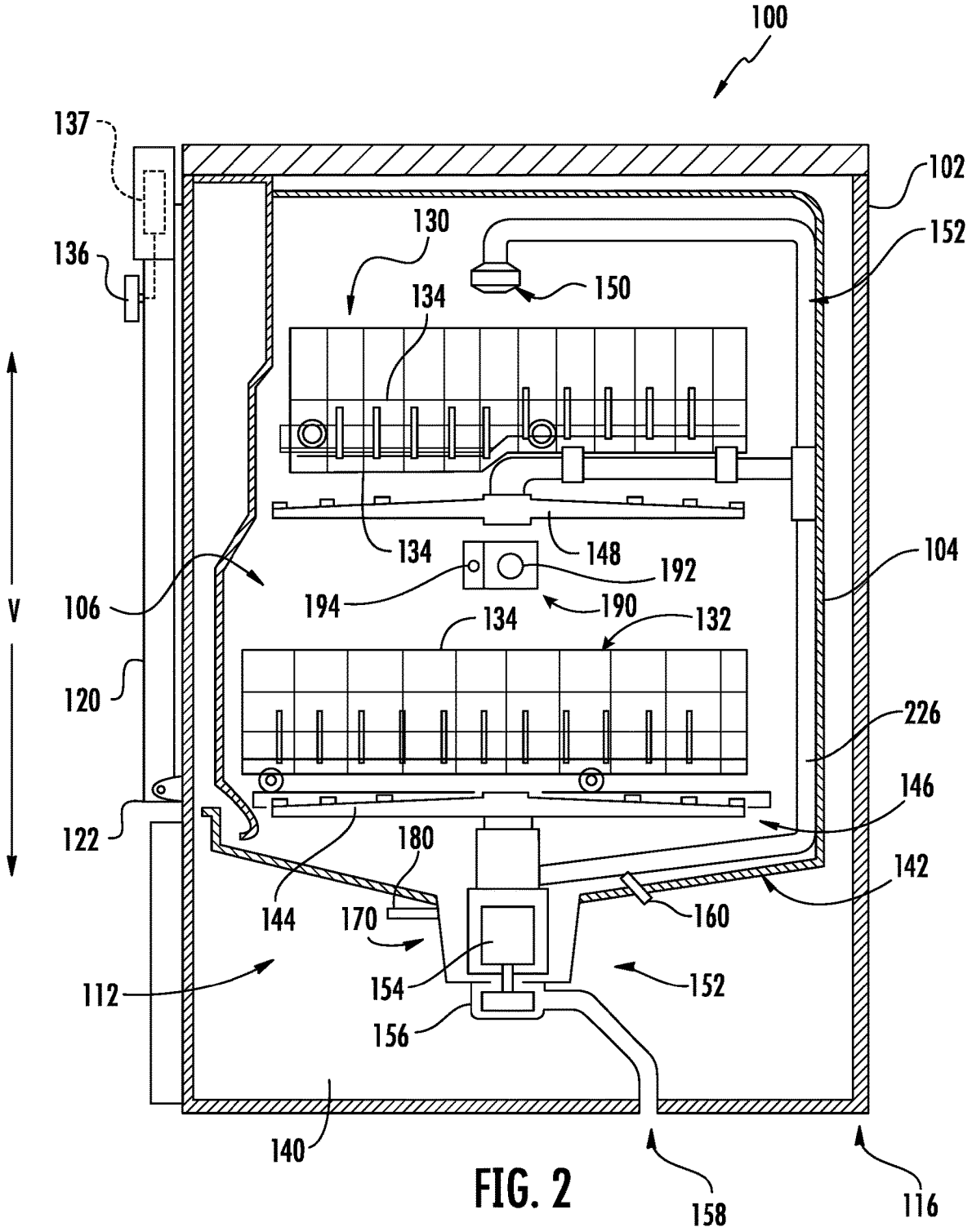
FIG. 2 provides a side, cross-sectional view of the exemplary dishwashing appliance of FIG. 1.

FIGS. 1 and 2 depict a dishwashing appliance 100 according to an exemplary embodiment of the present disclosure. As shown in FIG. 1, dishwashing appliance 100 includes a cabinet 102. Cabinet 102 has a tub 104 therein that defines a wash chamber 106. The tub 104 also defines a front opening permitting access to the wash chamber 106. Dishwashing appliance 100 includes a door 120 hinged at a bottom 122 of door 120 for movement between a normally closed, vertical position (shown in FIGS. 1 and 2), wherein wash chamber 106 is sealed shut for washing operation, and a horizontal, open position for loading and unloading of articles from dishwashing appliance 100. In some embodiments, a latch 123 is used to lock and unlock door 120 for access to wash chamber 106. Tub 104 also includes a sump 170 positioned adjacent a bottom portion 112 of tub 104 and configured for receipt of a liquid wash fluid (e.g., water, detergent, wash fluid, or any other suitable fluid) during operation of dishwashing appliance 100.

In certain embodiments, a spout 160 is positioned adjacent sump 170 of dishwashing appliance 100. Spout 160 is configured for directing liquid into sump 170. Spout 160 may receive liquid from, for example, a water supply (not shown) or any other suitable source. In alternative embodiments, spout 160 may be positioned at any suitable location within dishwashing appliance 100 (e.g., such that spout 160 directs liquid into tub 104). Spout 160 may include a valve (not shown) such that liquid may be selectively directed into tub 104. Thus, for example, during the cycles described below, spout 160 may selectively direct water or wash fluid into sump 170 as required by the current cycle of dishwashing appliance 100.

Rack assemblies 130 and 132 may be slidably mounted within wash chamber 106. In some embodiments, each of the rack assemblies 130 and 132 is fabricated into lattice structures including a plurality of elongated members 134. Each rack of the rack assemblies 130 and 132 is generally adapted for movement between an extended loading position (not shown) in which the rack is substantially positioned outside the wash chamber 106, and a retracted position (shown in FIGS. 1 and 2) in which the rack is located inside the wash chamber 106. A silverware basket (not shown) may be removably attached to rack assembly 132 for placement of silverware, utensils, and the like, that are otherwise too small to be accommodated by the racks 130 and 132.

In certain embodiments, dishwashing appliance 100 includes a lower spray assembly 144 that is rotatably mounted within a lower region 146 of the wash chamber 106 and above sump 170 so as to rotate in relatively close proximity to rack assembly 132. Optionally, a mid-level spray assembly 148 is located in an upper region of the wash chamber 106 and may be located in close proximity to upper rack 130. Additionally or alternatively, an upper spray assembly 150 may be located above the upper rack 130.

In exemplary embodiments, lower and mid-level spray assemblies 144 and 148 and the upper spray assembly 150 are fed by a fluid circulation assembly 152 for circulating water and dishwasher fluid in the tub 104. Fluid circulation assembly 152 includes one or more fluid pumps (e.g., a circulation pump 154 or a cross-flow/drain pump 156). In optional embodiments, circulation pump 154 is positioned at least partially within sump 170 and drain pump positioned below circulation pump 154 in fluid communication with sump 170. Additionally, drain pump 156 may be configured for urging the flow of wash fluid from sump 170 to a drain 158 when activated. By contrast, circulation pump 154 may be configured for supplying a flow of wash fluid from sump 170 to spray assemblies 144, 148 and 150 by way of one or more circulation conduits 226 when activated. Moreover, a filter assembly may be also positioned at least partially in sump 170 for filtering food particles or other debris, referred to herein generally as soils, from wash fluid prior to such wash fluid flowing to circulation pump 154.

Spray assemblies 144 and 148 include an arrangement of discharge nozzles or orifices for directing wash fluid onto dishes or other articles located in rack assemblies 130 and 132. The arrangement of the discharge nozzles in spray assemblies 144 and 148 provides a rotational force by virtue of wash fluid flowing through the discharge ports. The resultant rotation of the spray assemblies 144 and 148 provides coverage of dishes and other dishwasher contents with a spray of wash fluid.

It should be appreciated that the subject matter disclosed herein is not limited to any particular style, model or configuration of dishwashing appliance, and that the embodiments depicted in the figures are for illustrative purposes only. For example, instead of the racks 130 and 132 depicted in FIG. 1, dishwashing appliance 100 may be of a known configuration that utilizes drawers that pull out from the cabinet and are accessible from the top for loading and unloading of articles.

Dishwashing appliance 100 is further equipped with a controller 137 to regulate operation of the dishwashing appliance 100. Controller 137 may include a memory (e.g., non-transitive media) and microprocessor, such as a general or special purpose microprocessor operable to execute programming instructions or micro-control code associated with a washing operation. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 137 may be constructed without using a microprocessor (e.g., using a combination of discrete analog or digital logic circuitry, such as switches, amplifiers, integrators, comparators, flip-flops, AND gates, and the like) to perform control functionality instead of relying upon software.

Controller 137 may be positioned in a variety of locations throughout dishwashing appliance 100. In the illustrated embodiment, controller 137 may be located within a control panel area 121 of door 120 as shown. In such an embodiment, input/output ("I/O") signals may be routed between controller 137 and various operational components of dishwashing appliance 100 along wiring harnesses that may be routed through the bottom 122 of door 120. Typically, controller 137 includes a user interface panel 136 through which a user may select various operational features and modes and monitor progress of the dishwashing appliance 100. In one embodiment, user interface 136 may represent a general purpose I/O ("GPIO") device or functional block. In one embodiment, user interface 136 may include input components, such as one or more of a variety of electrical, mechanical or electro-mechanical input devices including rotary dials, push buttons, and touch pads. User interface 136 may include a display component, such as a digital or analog display device designed to provide operational feedback to a user. User interface 136 may be in communication (e.g., electrical or wireless communication) with controller 137 via one or more signal lines or shared communication busses.

In certain embodiments, dishwashing appliance 100 includes one or more sensors configured to detect a condition or characteristic of water within dishwashing appliance 100. For instance, a turbidity sensor 180 may be mounted to cabinet 102 in operable communication with wash chamber 106 (e.g., to detect or measure a value of total suspended solids, nephelometry, or light absorbance for water within or from wash chamber 106, as would be understood). In the illustrated embodiments, turbidity sensor 180 is mounted at sump 170 in fluid communication with wash chamber 106. During use, water within sump 170 or otherwise flowing to pump(s) 154 or 156 may thus be measured, such as by detecting the amount or intensity of light received from a light source directed through a volume of water 172 to a corresponding detector, which is generally understood. One or more signals corresponding to the measurement of the turbidity sensor 180 (i.e., sensor or turbidity signals) may, in turn, be transmitted to the controller 137, which may be in communication (e.g., electrical or wireless communication) with turbidity sensor 180.

In some embodiments, a camera assembly 190 that is generally positioned and configured for obtaining images of wash chamber 106 or a volume of water (e.g., as identified by reference numeral 172) within wash chamber 106 of dishwashing appliance 100. Specifically, according to the illustrated embodiment, camera assembly 190 may include a camera 192 mounted to a sidewall of tub 104. Camera 192 may be any type of device suitable for capturing a two-dimensional picture or image, such the image illustrated in FIG. 3 or 4. As an example, camera 192 may be a video camera or a digital camera with an electronic image sensor [e.g., a charge coupled device (CCD) or a CMOS sensor]. When assembled, camera 192 is in communication (e.g., electrical or wireless communication) with controller 137 such that controller 137 may receive a signal from camera 192 corresponding to the image captured by camera 192. Generally, camera 192 is directed toward wash chamber 106 such that the field of view for the camera 192 includes the bottom wall or sump 170 of tub 104. Optionally, camera 192 may be positioned above (i.e., at a higher location relative to the vertical direction V than) rack assembly 132. In turn, when rack assembly 132 is received within wash chamber 106, at least a portion of rack assembly 132 may be included within the field of view of camera 192. In this manner, camera 192 can take unobstructed images or video of an inside of wash chamber 106.

It should be appreciated that camera assembly 190 may include any suitable number, type, size, and configuration of camera(s) for obtaining images of wash chamber 106. In general, camera 192 may include a lens that is constructed from a clear hydrophobic material or which may otherwise be positioned behind a hydrophobic clear lens. So positioned, camera assembly 190 may obtain one or more images or videos of water within wash chamber 106 (e.g., at sump 170), as described in more detail below. It should be appreciated that other locations for mounting camera assembly 190 are possible, such as below rack assembly 132, above rack assembly 132, or within a top wall of tub 104 or adjacent a spray assembly of dishwashing appliance 100.

In exemplary embodiments, dishwashing appliance 100 further includes a tub light 194 that is positioned within cabinet 102 or wash chamber 106 for selectively illuminating wash chamber 106 and a volume of water 172 therein. For instance, tub light 194 may be integrated into camera assembly 190 and may be positioned immediately adjacent camera 192. According to still other embodiments, tub light 194 may be positioned at any other suitable location within cabinet 102.

Figure 3C:
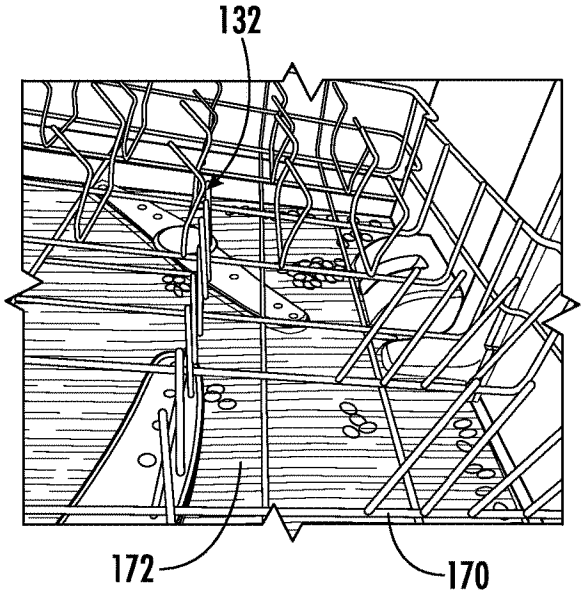
FIG. 3C provides an image of a volume of water classified in a suspended-particulate water condition a wash chamber of a dishwashing appliance according to exemplary embodiments of the present disclosure.
Figure 3B:
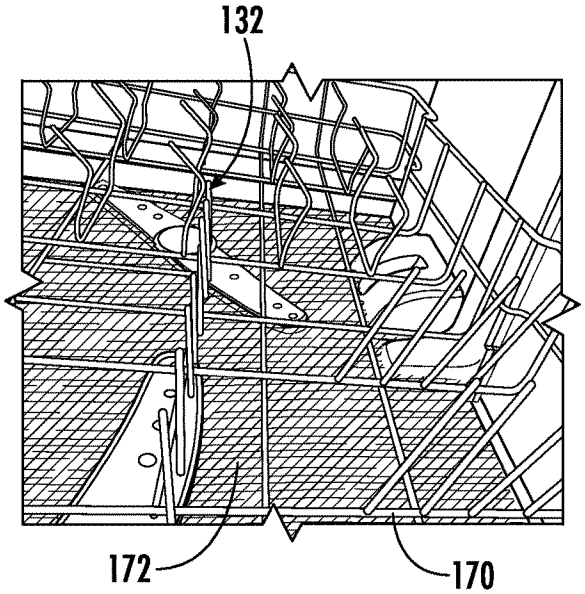
FIG. 3B provides an image of a volume of water classified in a discolored water condition a wash chamber of a dishwashing appliance according to exemplary embodiments of the present disclosure.
Figure 3A:
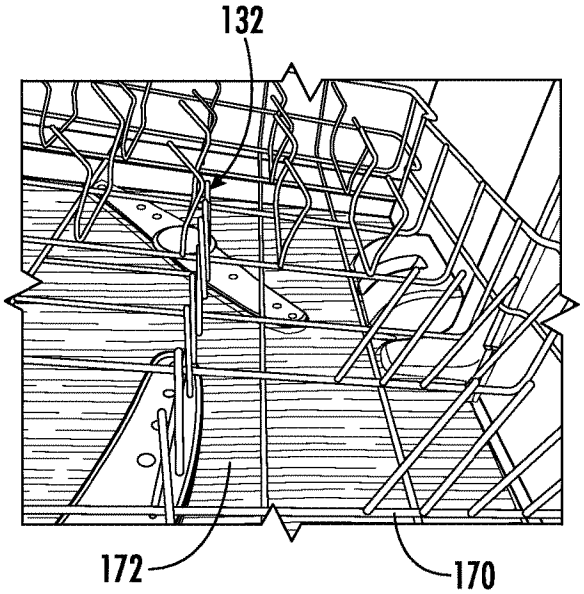
FIG. 3A provides an image of a volume of water in a clean water condition in a wash chamber of a dishwashing appliance according to exemplary embodiments of the present disclosure.
Figure 3D:
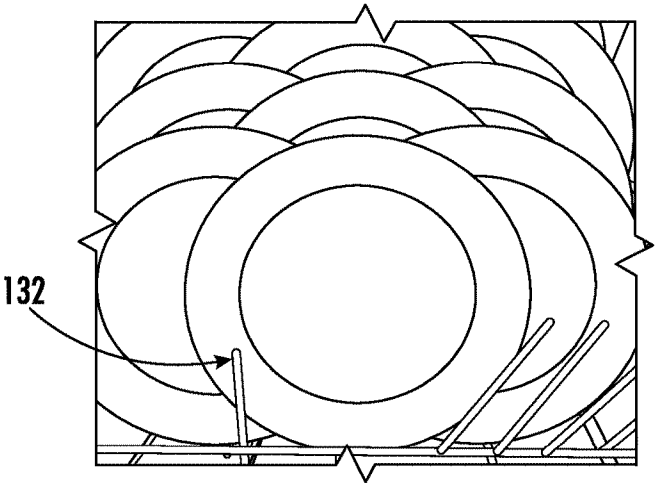
FIGS. 3D and 4 each provides an image of the wash chamber with articles held in a wash basket according to exemplary embodiments of the present disclosure.
Figure 4:
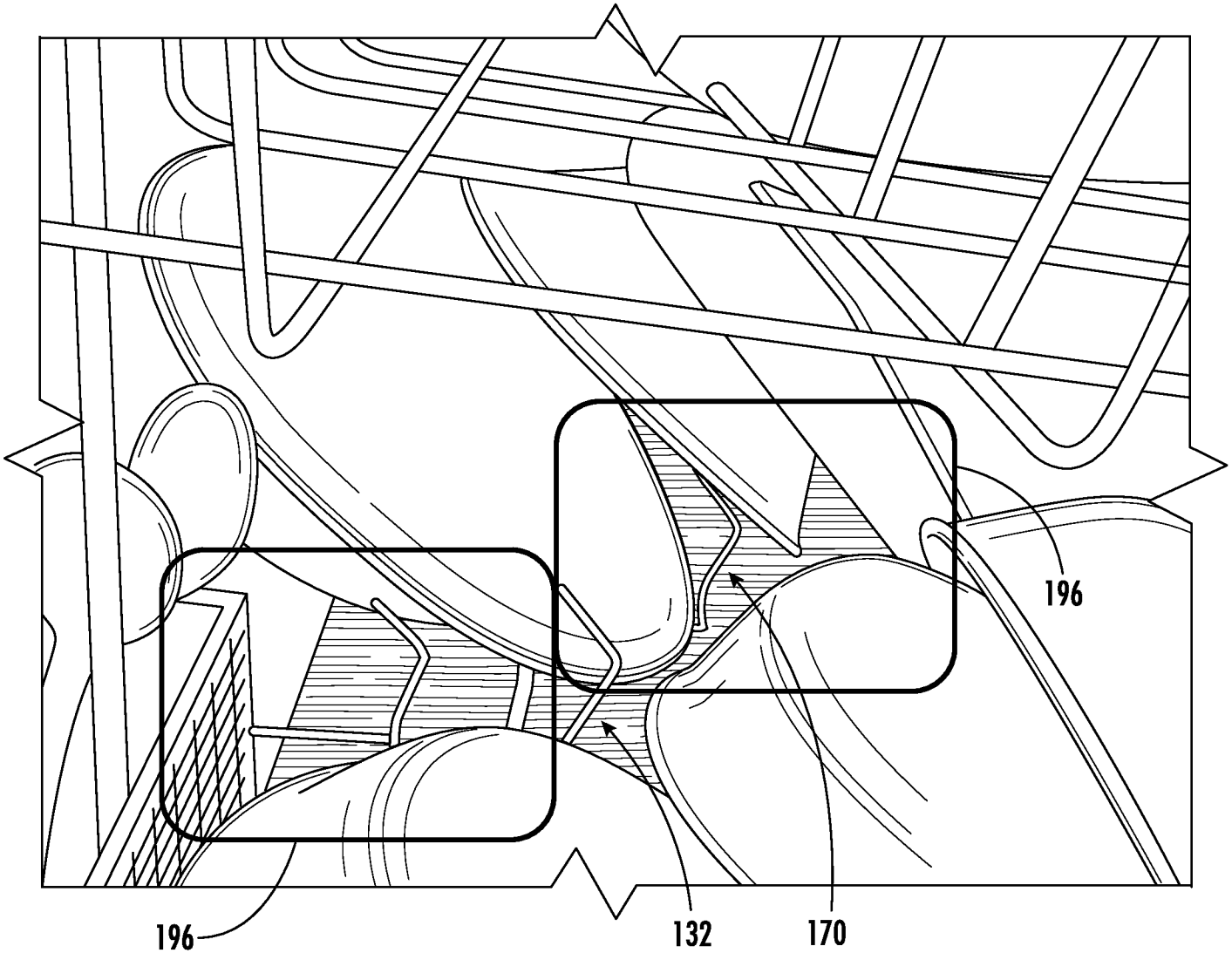

Turning briefly to FIGS. 3 and 4, various exemplary two-dimensional images related to drawer storage are illustrated, such as might be captured or obtained at camera 192 (FIG. 2). In other words, FIGS. 3 and 4 illustrate exemplary two-dimensional images such as might be obtained at camera 192 as part of an image capture sequence (e.g., at the time of various discrete water conditions for a volume of water 172 within sump 170). Thus, the images at FIGS. 3 and 4 illustrate a set field of view (or sub-region thereof) for camera 192 directed toward wash chamber 106.

As an example, FIG. 3A illustrates the volume of water 172 that is generally clean and unobscured within sump 170. In the particular case of FIG. 3A, the volume of water 172 is in an untinted water condition. No significant color may be visible within the volume of water 172 (i.e., occupy one or more pixels of the corresponding image of the volume of water). Additionally or alternatively, the volume of water 172 may be in a particulate-free water condition. No significant mass (e.g., mass above a predetermined threshold) of discrete, foreign objects (e.g., visually-distinct food particles) may be visible within the volume of water 172. Further additionally or alternatively, the volume of water 172 may be in a clear water condition. An upper surface of the sump 170 may, in turn, be visible through the volume of water 172.

As an additional or alternative example, FIG. 3B illustrates the volume of water 172 that is generally dirty and unobscured within sump 170. In the particular case of FIG. 3B, the volume of water 172 is in an tinted water condition. Thus, a significant color (e.g., brown, as indicated) may be visible within the volume of water 172. Additionally or alternatively, the volume of water 172 may be in a particulate-free water condition. No significant mass (e.g., mass above a predetermined threshold) of discrete, foreign objects (e.g., visually-distinct food particles) may be visible within the volume of water 172. Further additionally or alternatively, the volume of water 172 may be in a clear water condition. An upper surface of the sump 170 may, in turn, be visible through the volume of water 172.

As another additional or alternative example, FIG. 3C illustrates the volume of water 172 that is generally dirty and unobscured within sump 170. In the particular case of FIG. 3C, the volume of water 172 is in an untinted water condition. No significant color may be visible within the volume of water 172. Additionally or alternatively, the volume of water 172 may be in a particulate-laden water condition. Thus, a significant mass (e.g., mass above a predetermined threshold) of discrete, foreign objects (e.g., visually-distinct food particles) may be visible within the volume of water 172. Further additionally or alternatively, the volume of water 172 may be in a clear water condition. An upper surface of the sump 170 may, in turn, be visible through the volume of water 172.

Separate from or in addition to capturing images (e.g., for evaluation or determination of a water condition of the volume of water 172 within wash chamber 106), one or more sub-portions of the wash chamber 106 by be identified. For instance, as illustrated in FIG. 4, in instances wherein multiple articles block significant portions of the field of view for camera 192 (FIG. 2), controller 137 may be configured to identify unobscured subportions 196 of wash chamber 106 (e.g., below bottom rack assembly 132) based on signals or images received from the camera 192 (e.g., during or prior to an image capture sequence). For instance, from the two-dimensional images captured from the camera 192, the controller 137 may identify an unobscured subportion 196 as a region within the captured image in which the bottom surface of sump 170 (and any water resting thereon) is visible. Such an identification may be made, for example, using any suitable detection routine (e.g., executed at the controller 137) to detect one or more predetermined features of sump 170 in a two-dimensional image, as would be understood. Once unobscured subportion 196 is identified or determined to be present, the pixels therein may be further analyzed (e.g., using a suitable routine executed at the controller 137, such as to determine a water condition of a volume of water 172 within the wash chamber 106).

As used herein, the term "article" may refer to, but need not be limited to dishes, pots, pans, silverware, and other cooking utensils and items that can be cleaned in a dishwashing appliance 100. The term "wash cycle" is intended to refer to one or more periods of time during which a dishwashing appliance 100 operates while containing the articles to be washed and uses a detergent and water (e.g., to remove soil particles including food and other undesirable elements from the articles). The term "rinse cycle" is intended to refer to one or more periods of time during which the dishwashing appliance 100 operates to remove residual soil, detergents, and other undesirable elements that were retained by the articles after completion of the wash cycle. The term "drain cycle" is intended to refer to one or more periods of time during which the dishwashing appliance 100 operates to discharge soiled water from the dishwashing appliance 100.

Figure 5:
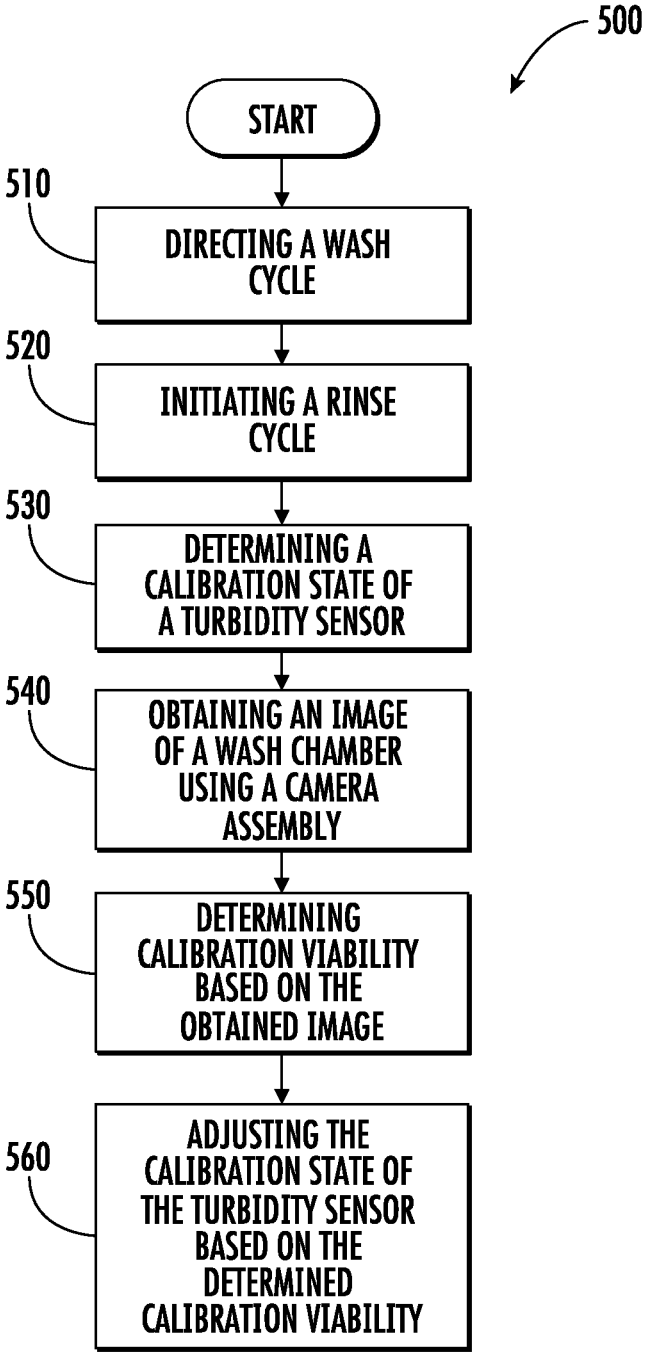
FIG. 5 provides a flow chart illustrating a method of operating a dishwashing appliance according to exemplary embodiments of the present disclosure.
Figure 6:
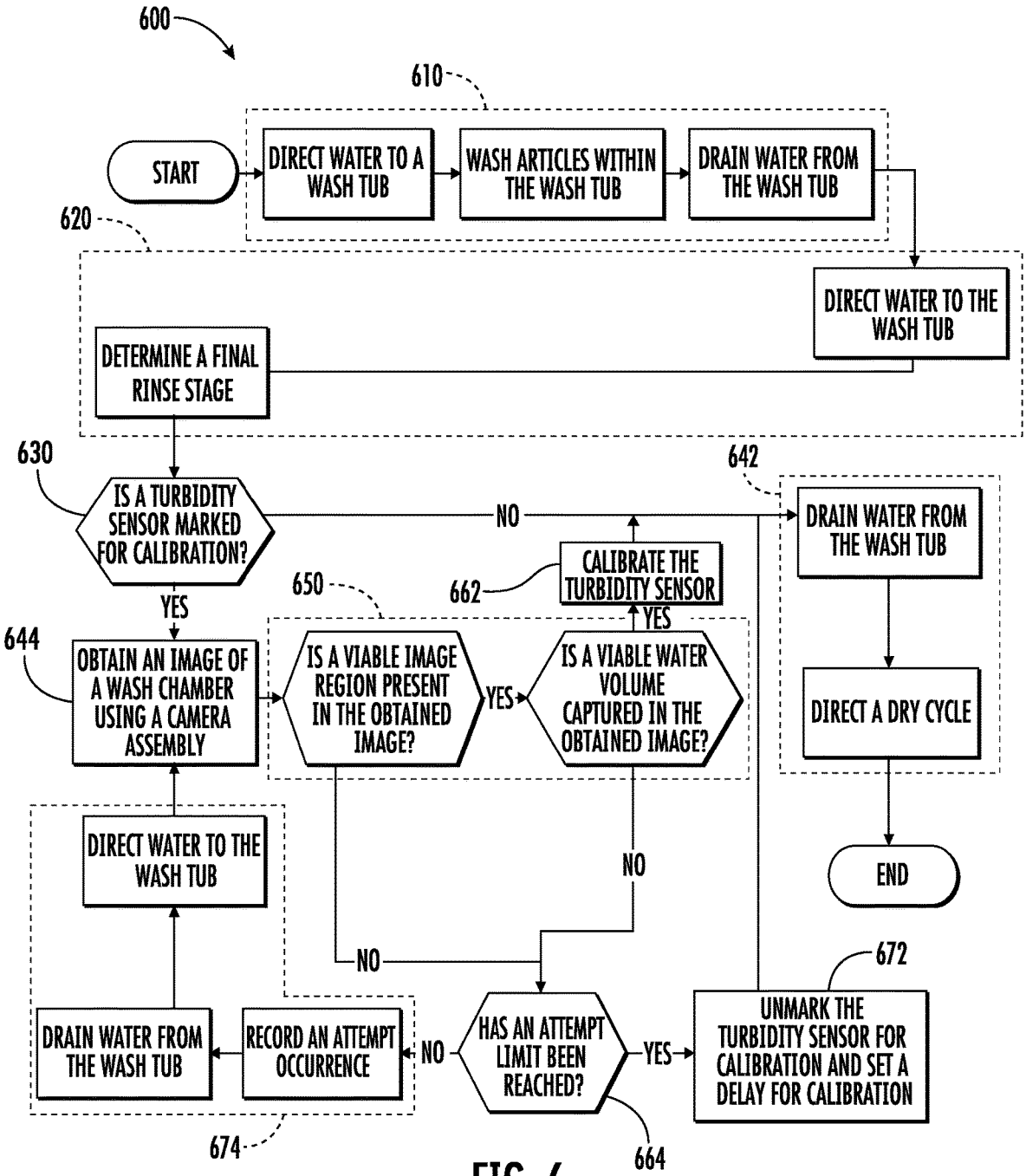
FIG. 6 provides a flow chart illustrating a method of operating a dishwashing appliance according to exemplary embodiments of the present disclosure.

Now that the construction of dishwashing appliance 100 and the configuration of controller 137 according to exemplary embodiments have been presented, exemplary methods 500 and 600 of operating a washing machine appliance will be described. In particular, FIGS. 5 and 6 provide flow charts methods 500 and 600 according to exemplary embodiments of the present disclosure. Generally, the methods 500 and 600 provide washing operations or methods of operating a dishwashing appliance 100 (FIG. 1) that includes a camera assembly 190, as described above. The method 500 or 600 can be performed, for instance, by the controller 137 (FIG. 2). For example, controller 137 may, as discussed, be in communication with camera assembly 190, pump(s) 154 or 156, or turbidity sensor 180 (FIG. 2). During operations, controller 137 may send signals to and receive signals from camera assembly 190, pump(s) 154 or 156, or turbidity sensor 180. Controller 137 may further be in communication with other suitable components of the appliance 100 to facilitate operation of the appliance 100 generally.

Although the discussion below refers to the exemplary methods 500 and 600 of operating dishwashing appliance 100, one skilled in the art will appreciate that the exemplary method 500 or 600 is applicable to the operation of a variety of other dishwashing appliance 100. Moreover, although methods 500 and 600 are described separately, one of ordinary skill would recognize that various steps may be interchanged and, thus, that the below discussion may be equally applicable to either method 500 or 600. Advantageously, methods in accordance with the present disclosure may ensure accurate readings from, or otherwise prevent inaccurate calibration of, a sensor (e.g., turbidity sensor 180) of the appliance.

Turning especially to FIG. 5, at 510, the method 500 includes directing a wash cycle. As described above, the wash cycle is understood to include a period during which the dishwashing appliance operates while containing the articles to be washed and uses a detergent and water (e.g., to remove soil particles including food and other undesirable elements from the articles). Thus, 510 may include directing water to the wash chamber, washing articles within the wash chamber (e.g., directing operation of one or more pump and releasing detergent to the wash chamber), and draining the water and detergent from the wash chamber, as would be understood.

At 520, the method 500 includes initiating a rinse cycle. Specifically, a volume of water may be directed to the wash chamber (e.g., through the spout). As would be understood, 520 may follow 510. The volume of water may be a new or "clean" volume of water coming directly from a water source (e.g., via the spout). In some embodiments, 520 includes circulating the volume of water through the wash chamber. Thus, the circulation pump may be activated to motivate water through the cabinet and one or more spray assemblies.

At 530, the method 500 includes determining a calibration state of the turbidity sensor. For instance, the turbidity sensor may be determined to be in need of calibration or in a calibration-necessitated state (e.g., marked for calibration). In other words, a determination may be made (e.g., at the controller) that the calibration sensor needs to be calibrated. Such a determination may be made according to a set calibration schedule programmed as any suitable calendar, timetable, or algorithm. For instance, the controller may be programmed to determine a calibration-necessitated state following execution of a predetermined number of wash cycles or washing operations. Additionally or alternatively, the controller may be programmed to determine a calibration-necessitated state following the passage of a predetermined period of time (e.g., measured in days, weeks, or months). Once a calibration sequence is executed, the turbidity sensor may be returned to a determined calibrated state. Thus, the turbidity sensor may be generally scheduled to be in the calibration-necessitated state at regular intervals according to the corresponding calendar, timetable, or algorithm.

At 540, the method 500 includes obtaining an image (e.g., two-dimensional image) of the wash chamber using the camera assembly. In other words, an image capture sequence may be initiated. In some embodiments, 540 occurs after 530. For instance, 540 may be in response to a determination that the turbidity sensor is in a calibration-necessitate state. Additionally or alternatively, 540 may follow 520. As described above, the camera may be at least partially directed at the sump. The obtained image may, in turn, include the volume of water directed to the wash chamber at 520.

According to exemplary embodiments, 540 may include taking one or more still images, one or more video clips, or any other suitable type and number of images suitable for water level detection analysis. It should be appreciated that the images obtained by camera assembly may vary in number, frequency, angle, resolution, detail, etc. in order to improve the clarity of the load of clothes and water within the wash chamber. Optionally, the controller may be configured to illuminate the tub using tub light during (e.g., just prior to or in tandem with obtaining images). Thus, 540 may include directing illumination of the wash chamber during capture of the image.

At 550, the method 500 includes determining calibration viability based on the obtained image. Specifically, the image of 540 may be analyzed to help ensure the conditions within wash chamber would be appropriate for calibration of the turbidity sensor (i.e., execution of a calibration sequence). In some embodiments, 550 includes analyzing the one or more images using a machine learning image recognition process.

In some such embodiments, a water condition of the volume of water within the wash chamber can be evaluated. As an example, such water conditions may include water color (e.g., whether a visible tint of the volume of water is detectable or visible within the pixels of the obtained image). Thus, it may be determined if the volume of water has a distinctive color (i.e., is in a tinted water condition), which may indicate dirty water, or has no significant color (i.e., is in an untinted water condition), which may indicate clean water (e.g., absent any contravening conditions). As an additional or alternative example, such water conditions may include suspended particulate within the volume of water. Thus, it may be determined if a significant mass (e.g., mass above a predetermined threshold) of discrete, foreign objects (e.g., visually-distinct food particles) is visible within the volume of water (i.e., a particulate-laden condition), which may indicate dirty water, or is not visible or detectable (i.e., a particulate-free condition), which may indicate clean water (e.g., absent any contravening conditions). As another additional or alternative example, such water conditions may include water clarity of the volume of water. Thus, thus it may be determined if the volume of water is cloudy (i.e., in a cloudy condition) such that the sump or bottom wall is significantly obfuscated by the volume of water, which may indicate dirty water, or is clear (i.e., in a clear condition) such that the upper surface of the sump or bottom wall is visible through the volume of water, which may indicate clean water (e.g., absent any contravening conditions)

As would be understood in light of the present disclosure, dirty water (i.e., water determined to be in a condition corresponding to dirty water) may be unsuitable for using during a calibration sequence and may lead to inaccurate calibration or future readings at the turbidity sensor. Thus, any condition corresponding to dirty water may indicate or prompt determination that calibration is unviable. By contrast, absent any water condition corresponding to dirty water (or determination solely of water conditions corresponding to clean water), a determination may be made that calibration is viable It should be appreciated that the threshold(s) for a determination of dirty water, which may vary depending on the operating cycle, the articles within the wash chamber, in a time-based manner, or based on any other suitable parameters or conditions. For example, the predetermined water conditions may be contingent on the content, color, or brightness values of the obtained image may be set or programmed in advance. According to exemplary embodiments, these parameters may be used along with a lookup table to determine the water conditions. In addition, the predetermined water level may be determined based at least in part on user inputs, operating cycle settings, etc.

Separate from or in addition to determination of the water condition(s), 550 may include analyzing the obtained image using a machine learning image recognition process to determine that the volume of water is visible. In other words, the obtained image may be analyzed to identify one or more unobscured subportions (e.g., if present within the image). If an unobscured subportion is not identified, a determination may be made that calibration is unviable.

As used herein, the terms "image recognition process" and similar terms may be used generally to refer to any suitable method of observation, analysis, image decomposition, feature extraction, image classification, etc. of one or more image or videos taken within a wash chamber of a dishwashing appliance. In this regard, the image recognition process may use any suitable artificial intelligence (AI) technique, for example, any suitable machine learning technique, or for example, any suitable deep learning technique. It should be appreciated that any suitable image recognition software or process may be used to analyze images taken by camera assembly and controller may be programmed to perform such processes and take corrective action.

According to an exemplary embodiment, controller may implement a form of image recognition called region based convolutional neural network ("R-CNN") image recognition. Generally speaking, R-CNN may include taking an input image and extracting region proposals that include a potential object or mass, such as the volume of water. In this regard, a "region proposal" may be regions in an image that could belong to a particular object or mass, such as a subregion or subportion (e.g., unobscured subportion) of the volume of water. A convolutional neural network is then used to compute features from the regions proposals and the extracted features will then be used to determine a classification for each particular region.

According to still other embodiments, an image segmentation process may be used along with the R-CNN image recognition. In general, image segmentation creates a pixel-based mask for each object in an image and provides a more detailed or granular understanding of the various objects or masses within a given image. In this regard, instead of processing an entire image—i.e., a large collection of pixels, many of which might not contain useful information—image segmentation may involve dividing an image into segments or subportions (e.g., into groups of pixels containing similar attributes) that may be analyzed independently or in parallel to obtain a more detailed representation of the object(s) or mass(es) in an image. This may be referred to herein as "mask R-CNN" and the like.

According to still other embodiments, the image recognition process may use any other suitable neural network process. For example, 550 may include using Mask R-CNN instead of a regular R-CNN architecture. In this regard, Mask R-CNN is based on Fast R-CNN which is slightly different than R-CNN. For example, R-CNN first applies CNN and then allocates it to zone recommendations on the covn5 property map instead of the initially split into zone recommendations. In addition, according to exemplary embodiments standard CNN may be used to obtain a quantification of a water condition. In addition, a K-means algorithm may be used. Other image recognition processes are possible and within the scope of the present subject matter.

It should be appreciated that any other suitable image recognition process may be used while remaining within the scope of the present subject matter. For example, 550 of analyzing the one or more images may include using a deep belief network ("DBN") image recognition process. A DBN image recognition process may generally include stacking many individual unsupervised networks that use each network's hidden layer as the input for the next layer. According to still other embodiments, 550 may include the implementation of a deep neural network ("DNN") image recognition process, which generally includes the use of a neural network (computing systems inspired by the biological neural networks) with multiple layers between input and output. Other suitable image recognition processes, neural network processes, artificial intelligence ("AI") analysis techniques, and combinations of the above described or other known methods may be used while remaining within the scope of the present subject matter.

According to exemplary embodiments of the present disclosure, the image analysis performed at 550 may generally monitor any suitable qualitative or quantitative aspect of a water condition of the volume of water or condition of the wash chamber generally that might be indicative of suitable conditions for calibrating the sensor. For example, the analysis may include evaluating one or more water conditions or whether the volume of water is visible at the sump (e.g., whether the bottom of tub is obscured by one or more articles held within a rack assembly), as described above.

At 560, the method 500 includes adjusting the calibration state of the turbidity sensor based on the determined calibration viability. If a determination is made that calibration is viable (i.e., the determined calibration viability is positive), the controller may direct or initiate a calibration sequence for the turbidity sensor. Such calibration sequences may be specific to the type of turbidity sensor mounted within the dishwashing appliance, and are generally understood in the art.

By contrast, if a determination is made that calibration is unviable (i.e., the determined calibration viability is negative), the controller may delay a calibration sequence. In other words, the calibration state of the turbidity sensor may be temporarily set to a determined calibrated state (e.g., for the duration of a set delay period of time, cycles, or washing operations). Optionally, the wash chamber may be refilled (i.e., the volume of water may be drained and a new volume of water may be provided to the wash chamber) before the method 500 returns to 540 and attempts to obtain a new image that can then be evaluated for a new determination of calibration viability. Additionally or alternatively, a set delay period (e.g., number of days, wash cycles, wash operations, etc.) may be added to the set calibration schedule for the turbidity sensor. Thus, the controller may again attempt to calibrate the turbidity sensor after the set delay period expires.

Following 560, the washing operation may end or proceed to completion, and may thus include directing a draining or drying of the wash chamber, as would be understood.

Turning now to FIG. 6, at 610, the method 600 includes directing a wash cycle. As described above, the wash cycle is understood to include a period during which the dishwashing appliance operates while containing the articles to be washed and uses a detergent and water (e.g., to remove soil particles including food and other undesirable elements from the articles). Thus, 610 may include directing water to the wash chamber, washing articles within the wash chamber (e.g., directing operation of one or more pump and releasing detergent to the wash chamber), and draining the water and detergent from the wash chamber, as would be understood.

At 620, the method 600 includes initiating a rinse cycle following 610. Specifically, a volume of water may be directed to the wash chamber (e.g., through the spout). The volume of water may thus be a new or "clean" volume of water coming directly from a water source (e.g., via the spout). In some embodiments, 620 includes circulating the volume of water through the wash chamber. Thus, the circulation pump may be activated to motivate water through the cabinet and one or more spray assemblies. Optionally, multiple rinse cycles or stages may be performed. In turn, 610 may include determining a final rinse stage is reached wherein a volume of water may be held within the bottom of sump.

At 630, the method 600 includes determining a calibration state of the turbidity sensor. For instance, the controller may be determined to be in need of calibration or in a calibration-necessitated state. Specifically, a determination may be made that the calibration sensor is marked for calibration according to a set calibration schedule programmed as any suitable calendar, timetable, or algorithm. If the turbidity sensor is not marked for calibration, the method 600 may proceed to 642. By contrast, if the turbidity sensor is marked for calibration, the method 600 may proceed to 644.

At 642, the method 600 includes directing drying of the wash chamber (e.g., and any articles therein). Thus, the volume of water may be drained from the wash tub (e.g., as motivated by the drain pump). Moreover, a dry cycle may be directed. For instance, as would be understood, one or more heating elements may be activated to help evaporate undrained water or water vapor within the wash chamber.

At 644, the method 600 includes obtaining an image (e.g., two-dimensional image) of the wash chamber using the camera assembly. As described above, the camera may be at least partially directed at the sump. The obtained image may, in turn, include a volume of water directed to (and held within) the wash chamber at 620.

According to exemplary embodiments, 644 includes taking one or more still images, one or more video clips, or any other suitable type and number of images suitable for water level detection analysis. It should be appreciated that the images obtained by camera assembly may vary in number, frequency, angle, resolution, detail, etc. in order to improve the clarity of the load of clothes and water within wash chamber. Optionally, the controller may be configured to illuminate the tub using tub light just prior to obtaining images. Thus, 644 may include directing illumination of the wash chamber during capture of the image. Following or in response to 644, the method 600 may proceed to 650.

At 650, the method 600 includes analyzing the obtained image at 644. For instance, the image may be analyzed to determine if a viable image region (e.g., unobscured subportion) is present in the obtained image. As described above, this may include using a machine learning image recognition process to determine that the volume of water is visible. In other words, the obtained image may be analyzed to identify one or more unobscured subportions (e.g., if present within the image).

If an unobscured subportion is not identified, the method 600 may proceed to 664. By contrast if a viable image region or unobscured subportion is present, 650 may proceed to analyzing the image for a viable water volume. For instance, one or more water conditions may be evaluated to determine if the volume of water is appropriate for using in a calibration sequence. As described above, such water conditions may include one or more conditions that may indicate if water is dirty (i.e., not viable and thus unsuitable for calibration) or clean (i.e., viable and suitable for calibration). Dirty water conditions may include a tinted water condition, a particulate-laden water condition, or a cloudy water condition. Clean water conditions may include an untinted water condition, a particulate-free water condition, or a clear water condition. If no dirty water conditions are determined, the method 600 may proceed to 662. By contrast, if one or more dirty water conditions are determined, the method 600 may proceed to 664.

At 662, the method 600 includes calibrating the turbidity sensor. In other words, a calibration sequence may be initiated. Such calibration sequences may be specific to the type of turbidity sensor mounted within the dishwashing appliance, and are generally understood in the art. Following the calibration sequence, the method 600 may proceed to 642.

At 664, the method 600 includes determining if an attempt limit has been reached. The attempt limit may be programmed as a predetermined threshold for the number of times in which calibration viability should be evaluated (e.g., within a single washing operation). Thus, an internal count of the number of viability attempts (e.g., instances of 650 within a single washing operation) may be recorded and stored within the controller. If the attempt limit has been reached (i.e., the internal count equals or exceeds the attempt limit), the method 600 may proceed to 672, which includes updating the calibration state of the turbidity sensor by unmarking the turbidity sensor for calibration and setting a delay for calibration (e.g., as described above) before proceeding to 642. If the attempt limit has not been reached, the method 600 may proceed to 674.

At 674, the method 600 includes resetting the wash chamber. Specifically, the internal count may be increased (e.g., by 1) and the volume of water may be drained from the wash chamber (e.g., by activating the drain pump to motivate water from the wash chamber and the cabinet, generally). Subsequently, a new volume of water may be provided to the wash chamber before the method 600 returns to 644, as shown.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a dishwashing appliance comprising a cabinet, a tub defining a wash chamber within the cabinet, a camera assembly mounted within the cabinet in view of the wash chamber, and a turbidity sensor mounted in fluid communication with the wash chamber, the method comprising:

initiating a rinse cycle;

obtaining an image of the wash chamber, the obtained image including a representation of a volume of water within the wash chamber;

determining calibration viability between viable or unviable for the turbidity sensor based on the obtained image, calibration viability being a threshold for executing a calibration sequence at the turbidity sensor, viable indicating the determined calibration viability is positive for executing the calibration sequence and unviable indicating the determined viability is negative for executing the calibration sequence; and adjusting a calibration state of the turbidity sensor for executing the calibration sequence based on the determined calibration viability between viable or unviable.

2. The method of claim 1, wherein initiating the rinse cycle comprises directing the volume of water to the wash chamber.

3. The method of claim 2, wherein determining calibration viability comprises evaluating a water condition of the volume of water in the obtained image.

4. The method of claim 3, wherein the water condition comprises water color of the volume of water or suspended particulate within the volume of water.

5. The method of claim 3, wherein evaluating the water condition of the volume of water comprises:

analyzing the obtained image using a machine learning image recognition process to determine that the volume of water is visible.

6. The method of claim 5, wherein the machine learning image recognition process comprises at least one of a convolution neural network ("CNN"), a region-based convolution neural network ("R-CNN"), a deep belief network ("DBN"), or a deep neural network ("DNN") image recognition process.

7. The method of claim 1, further comprising directing illumination of the wash chamber during obtaining the image.

8. The method of claim 1, wherein adjusting the calibration state of the turbidity sensor comprises delaying a calibration sequence for the turbidity sensor.

9. The method of claim 1, wherein adjusting the calibration state of the turbidity sensor comprises initiating a calibration sequence for the turbidity sensor.

10. The method of claim 1, wherein the calibration state of the turbidity sensor prior to adjusting is a calibration-necessitated state according to set calibration schedule.

11. A dishwashing appliance, comprising:

a cabinet;

a tub positioned within the cabinet and defining a wash chamber for receipt of articles for washing;

a spray assembly positioned within the wash chamber;

a drain pump in fluid communication with the wash chamber;

a turbidity sensor mounted within the cabinet; and a controller in operative communication with the turbidity sensor and the drain pump, the controller being configured to initiate a wash operation, the wash operation comprising initiating a rinse cycle, obtaining an image of the wash chamber, the obtained image including a representation of a volume of water within the wash chamber, determining calibration viability between a viable or unviable for the turbidity sensor based on the obtained image, calibration viability being a threshold for executing a calibration sequence at the turbidity sensor, viable indicating the determined calibration viability is positive for executing the calibration sequence and unviable indicating the determined viability is negative for executing the calibration sequence, and adjusting a calibration state of the turbidity sensor for executing the calibration sequence based on the determined calibration viability between a viable or unviable.

12. The dishwashing appliance of claim 11, wherein initiating the rinse cycle comprises directing the volume of water to the wash chamber.

13. The dishwashing appliance of claim 12, wherein determining calibration viability comprises evaluating a water condition of the volume of water in the obtained image.

14. The dishwashing appliance of claim 13, wherein the water condition comprises water color of the volume of water or suspended particulate within the volume of water.

15. The dishwashing appliance of claim 13, wherein evaluating the water condition of the volume of water comprises:

analyzing the obtained image using a machine learning image recognition process to determine that the volume of water is visible.

16. The dishwashing appliance of claim 15, wherein the machine learning image recognition process comprises at least one of a convolution neural network ("CNN"), a region-based convolution neural network ("R-CNN"), a deep belief network ("DBN"), or a deep neural network ("DNN") image recognition process.

17. The dishwashing appliance of claim 11, further comprising directing illumination of the wash chamber during obtaining the image.

18. The dishwashing appliance of claim 11, wherein adjusting the calibration state of the turbidity sensor comprises delaying a calibration sequence for the turbidity sensor.

19. The dishwashing appliance of claim 11, wherein adjusting the calibration state of the turbidity sensor comprises initiating a calibration sequence for the turbidity sensor.

20. The dishwashing appliance of claim 11, wherein the calibration state of the turbidity sensor prior to adjusting is a calibration-necessitated state according to set calibration schedule.

* * * * *